US005470095A

United States Patent [19]

Bridges

[11] Patent Number: 5,470,095

[45] Date of Patent: Nov. 28, 1995

[54] TRANSPORTABLE GOLF BAG

[76] Inventor: James E. Bridges, 110 River North Ct., Atlanta, Ga. 30328

[21] Appl. No.: 278,176

[22] Filed: Jul. 20, 1994

[51] Int. Cl.[6] ..... B62B 1/12

[52] U.S. Cl. ..... 280/646; 280/42; 280/655; 280/DIG. 6

[58] Field of Search ..... 280/645, 646, 280/42, 651, 652, 655, 47.17, 47.24, 47.26, DIG. 6

[56] References Cited

U.S. PATENT DOCUMENTS

| | | | |
|---|---|---|---|
| 2,428,954 | 10/1947 | Apblett et al. | 280/DIG. 6 X |
| 2,579,937 | 12/1951 | Larsen | 280/42 |
| 2,743,115 | 4/1956 | Rutledge | 280/42 |
| 2,902,287 | 9/1959 | Elias | 280/DIG. 6 X |
| 3,985,373 | 10/1976 | Widegren | 280/652 |
| 4,792,152 | 12/1988 | Carolan | 280/47.26 |
| 4,793,622 | 12/1988 | Sydlow | 280/646 X |
| 4,822,071 | 4/1989 | Widegren | 280/646 |
| 4,911,465 | 3/1990 | Hauer | 280/646 |
| 5,112,068 | 5/1992 | Liao et al. | 280/30 |

*Primary Examiner*—Margaret A. Focarino
*Assistant Examiner*—Michael Mar
*Attorney, Agent, or Firm*—Kenneth S. Watkins, Jr.

[57] ABSTRACT

A transportable golf bag is disclosed which comprises a pair of deployable wheel assemblies attached to the lower portion of a semi-rigid golf bag. The bag forms the structure of the device without requiring a separate frame or chassis. The wheel assemblies can be locked in a deployed or stored position. The stowed wheels are covered by a closable pocket. A deployable handle for pulling the bag, and a deployable leg for supporting the bag in an upright position can be stowed when not in use.

5 Claims, 4 Drawing Sheets

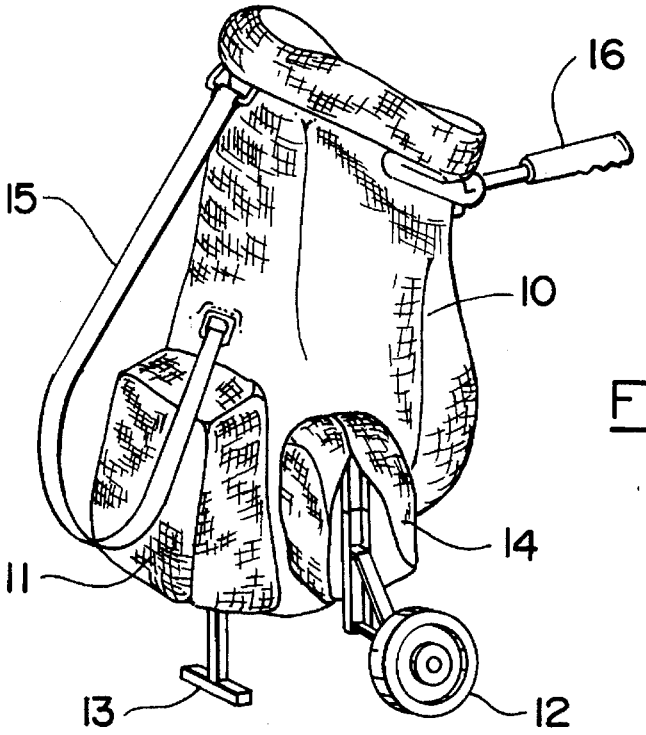
Fig- 1
Fig- 2
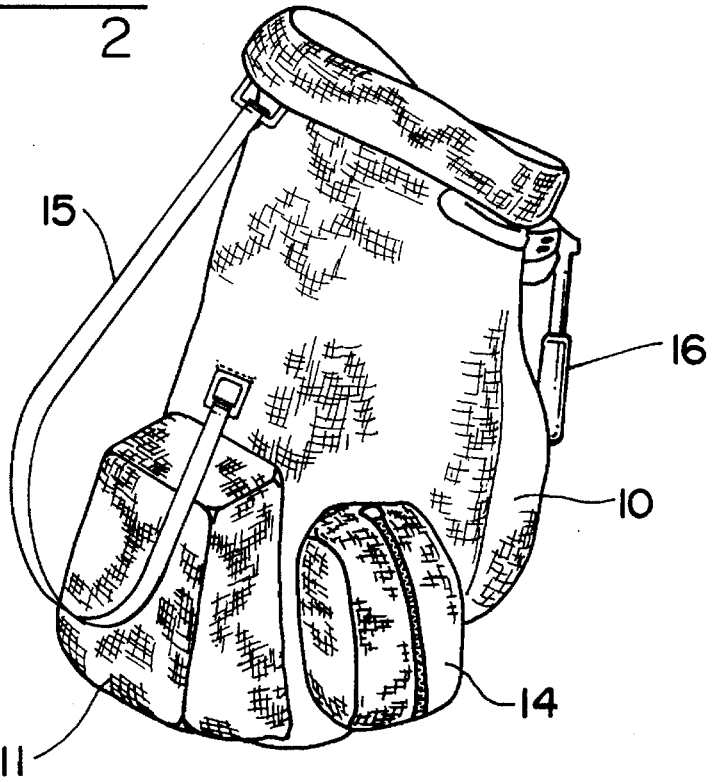

Fig- 6
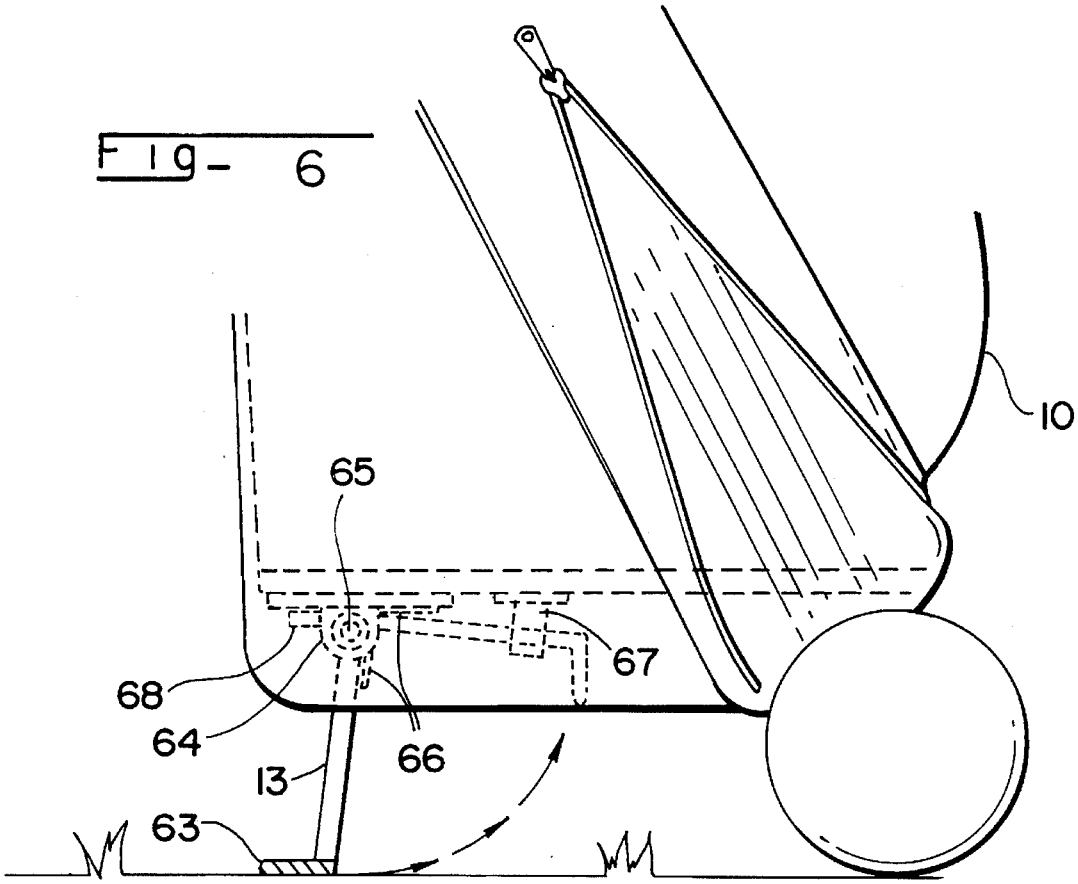
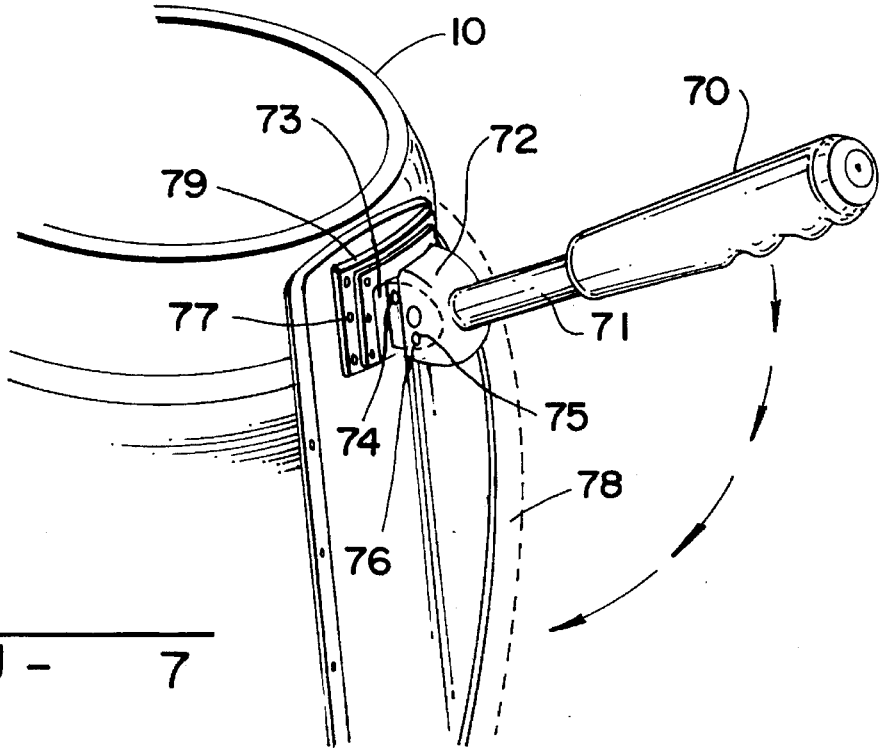
Fig- 7

TRANSPORTABLE GOLF BAG

BACKGROUND

The advent of several new technologies has made significant changes on the golf course. High technology clubs, putters, golf balls and accessories have made their way into the game in increasing numbers. Modern golfers, in an effort to continually improve their game, are utilizing more and more of these products. For example, additional clubs and putters will often be carried to take advantage of the particular characteristics of these specialized clubs and putters.

The growing trend in motorized golf carts has reduced the concern for the size and weight of golf bags. This fact, together with the desire for an attractive and convenient golf bag capable of storing all of the conceivable new equipment, has led to a significant increase in the size and weight of many golf bags.

Handling and transporting these larger and heavier golf bags has become a problem. In particular, transporting the bag from the house to the car and from the car to the golf cart has become a major evolution, especially for senior citizens who may not have the physical strength necessary for such a task. For longer distances, such as those which would occur in an airport, transporting the golf bag is a strenuous task.

Another segment of the golfing community would prefer to transport their bag around the course for the exercise. This is often a physical impossibility due to the size and weight of the bag.

In the past, separate golf bag carriers have been used to transport the bag. The inconvenience of having to carry and store a separate piece of equipment has limited their use.

Several golf bags have been disclosed which comprise self contained apparatus for aiding in transporting the bag. This apparatus, normally in the form of wheels, can be deployed in a number of different ways. For example, U.S. Pat. No. 5,112,068 to Liao et al. discloses a golf bag with a T-shaped element into which the axles of the wheels may be inserted. The wheels are removed and stored in a storage pocket of the bag when not in use. U.S. Pat. No. 4,911,465 to Hauer discloses a golf bag with retractable wheel structures stored between two spaced cylindrical compartments. These and other transportable devices have not fully solved the problems due to inconvenient deployment or storage, or they are unduly complicated and expensive.

Therefore an object of the present invention is to provide a golf bag with a self contained transporting apparatus which can be quickly and easily deployed and stored.

A further object of the present invention is to provide a transportable golf bag which is simple and inexpensive to manufacture.

Yet another object of the present invention is to provide a golf bag with a deployable handle for convenient pulling of the bag along a surface.

Still another object of the present invention is to provide a golf bag with a deployable leg to support the bag in an upright orientation for easy access and retrieval of equipment in the bag.

SUMMARY

My invention comprises a transportable golf bag which can be used to carry and hold golf clubs, putters, golf balls and accessories. It contains a pair of deployable and storable wheel assemblies; one located one each side of the lower portion of the bag. The design of the bag and wheel assemblies results in easy transporting of the bag. It is simple and convenient to use.

The device comprises a golf bag made of a semi-rigid material. This construction allows attachment of the wheel assemblies directly to the lower portion of the bag and therefore does not require a separate frame or chassis, saving weight and cost.

The wheel assemblies comprise a deployable strut, the upper end of which is slideably attached to the lower portion of the bag. A rotatable wheel is attached to the lower end of the deployable strut.

In the preferred embodiment of the present invention, each wheel assembly comprises a flanged longitudinal track member which is attached to the lower portion of the semi-rigid bag with a backing plate and fasteners. A pivotal strut is pivotally attached to an upper slide which slides in the track. A rotatable wheel is attached to the lower end of the pivotal strut. One end of a collapsible strut is attached to a lower slide which is slideably mounted in the track. The other end of the collapsible strut is attached to the pivotal strut. A closable pocket covers the wheel assembly when it is in the collapsed or stowage position.

In an alternative embodiment of the present invention, a lock is utilized to lock at least one of the slides in the track. The position of the slides and struts define the deployed and stowed position of the wheel assemblies.

Another embodiment of the present invention comprises a deployable leg on the bottom of the bag, forming a triangular pattern with the wheels. The leg provides a support for maintaining the bag in an upright position. A foldable or deployable handle attached to the upper portion of the bag utilizing a flange and backing plate is used to pull the bag. The handle can be folded against the bag and covered with a closable pocket when not in use.

BRIEF DESCRIPTION OF THE DRAWINGS

These and other features, aspects, and advantages of the present invention will become better understood with regard to the following description, appended claims, and accompanying drawings where:

FIG. 1 is a perspective drawing of the present invention with the wheel assemblies deployed;

FIG. 2 is a perspective drawing of the present invention with the wheel assemblies stowed;

FIG. 6 is a elevation detail of the deployable leg; and

FIG. 7 is a perspective detail of the deployable handle of the preferred embodiment.

DETAILED DESCRIPTION

Figure 3:
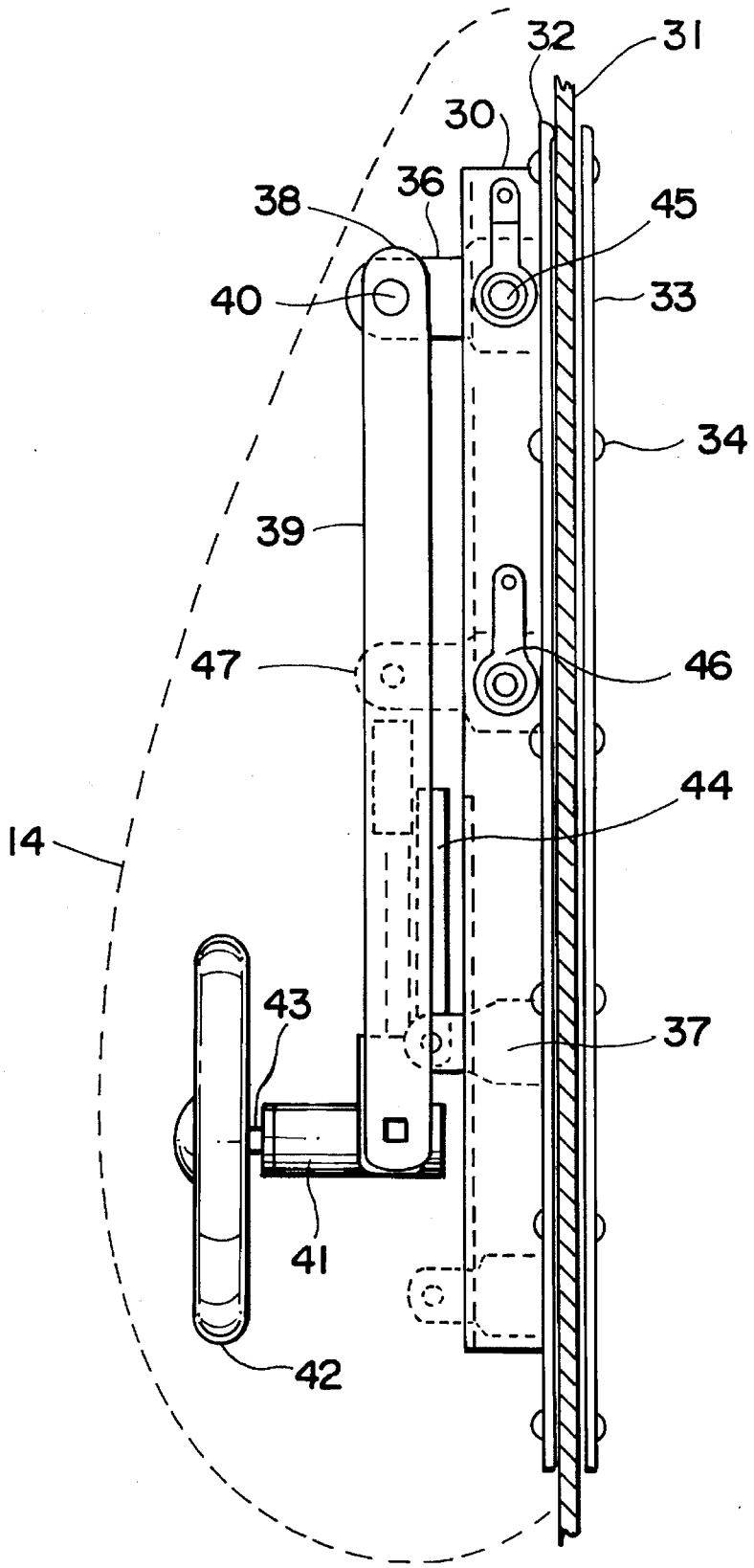
FIG. 3 is an elevation detail of the wheel assembly of the preferred embodiment in the stowed position.

The following detailed description discloses a transportable golf club holder which is simple and easy to operate.

FIG. 1 is a perspective drawing of the device in a deployed or operating mode. A golf club bag 10, made of a semi-rigid material, is used to hold golf clubs, golf balls, and other items used by golfers. Accessory pocket 11 is used to organize and store accessory items. A pair of wheel assemblies 12 are used to transport the device when deployed as shown in the figure. One wheel assembly is located on each side of the lower portion of the bag. Deployable leg 13 is used to support the device in a standing or upright position when deployed as shown in the figure. Pockets 14 store and cover wheel assemblies 12 when in the stowed position. Carrying strap 15 is used to carry or hang the bag. Handle 16 is used to transport the device when in the deployed position shown in the figure.

FIG. 2 shows the device in its stowed mode with wheel assemblies covered by pockets 14, deployable handle 16 in its stowed position, and deployable leg 13 (not shown) in its stowed position.

FIG. 3 is a detail elevation drawing of wheel assembly 12 in its stowed or retracted position. Longitudinal track member 30 is attached to the lower portion of bag 31. Bag 31 is between flange 32 of track member 30 and backing plate 33. Fasteners 34 connect flange 32 to backing plate 33 clamping bag 31. The flange and backing plate distribute the load of the attachment point to a larger area of the bag than the fasteners or track alone. The lower portion of bag 31 is made of a semi-rigid material. A semi-rigid material is defined as a material which has enough rigidity to maintain its overall shape when a deforming force corresponding to the distributed load of the wheel assemblies in normal operation is applied yet it retains enough resiliency to provide shock and rubbing protection for the contents of the bag. A suitable material having these attributes may be heavy leather or a plastic material. The use of flange 32, backing plate 33 and a semi-rigid material for bag 31 ensures that the wheel assembly retains the desired alignment with the bag when transporting the device over rough terrain. This structure requires no separate frame or chassis, thereby reducing cost and simplifying the device.

The longitudinal axis of longitudinal track member 30 may be co-linear with the longitudinal axis of the bag or it may be angled as indicated in FIG. 1 to increase stability by moving the deployed location of the wheels away from the centerline of the bag.

Upper slide 36 and lower or second slide 37 ride in track 30 and are in their upper positions as shown when the wheel assembly is in its stowed position. Top or first end 38 of deployable or pivotal strut 39 is connected to top slide 36 by pivot pin 40. Axle assembly 41 is attached to second or bottom end of pivotal strut 39. Wheel 42 rotates about axle 43 of axle assembly 41. Collapsible strut 44 is connected between pivotal strut 39 and lower or second slide 37. Spring lock 45 locks upper slide 36 in its upper or stowed position and lock 46 locks slide 36 in its lower or deployed position 47.

Figure 4:
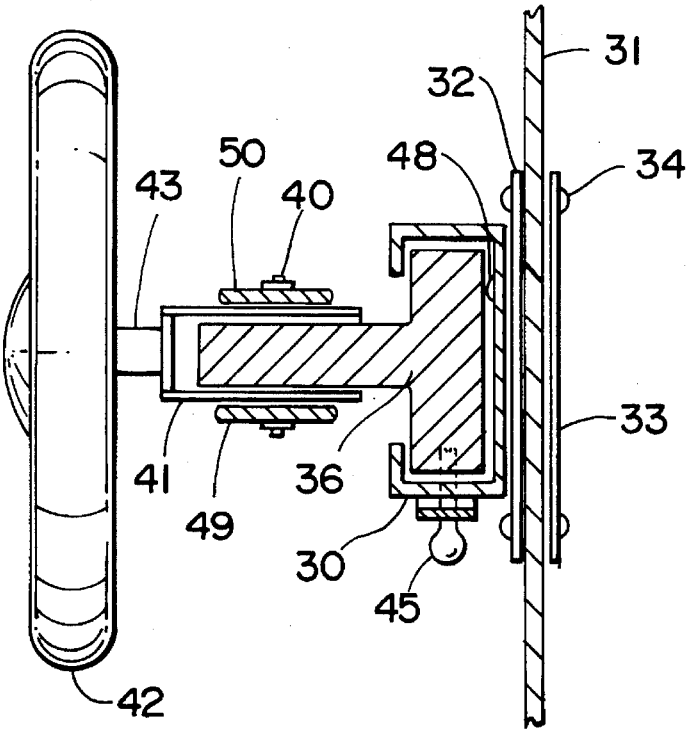
FIG. 4 is a top sectional view of the wheel assembly in the stowed position.

FIG. 4 is a top sectional view of FIG. 3 showing semi-rigid bag 31 clamped between flange 32 of track 30 and backing plate 33 utilizing fasteners 34. Track 30 is attached to flange 32 by fasteners 48. Track 30 has a C-shaped cross section and retains T-shaped slide 36. Slide 36 slides longitudinally in track 30. Pivotal strut 39 comprises leg 49 and leg 50 which are pivotally attached to slide 36 by pivot pin 40.

Figure 5:
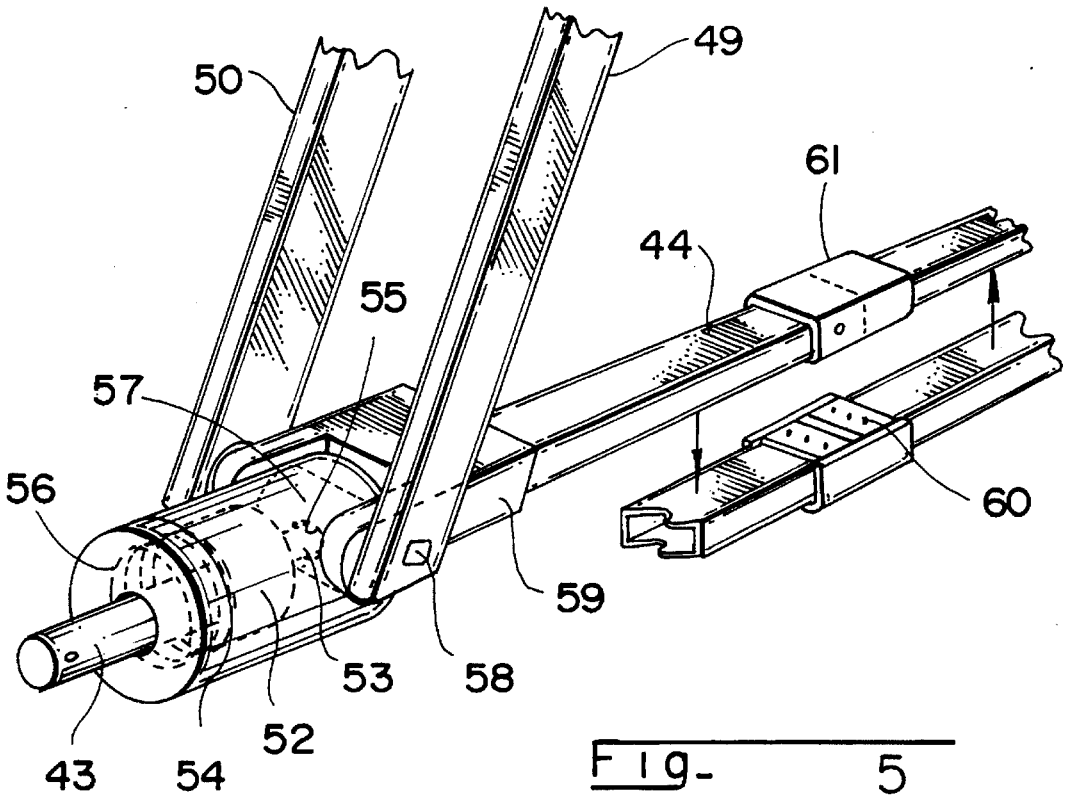
FIG. 5 is a perspective drawing of the wheel assembly in a deployed position.

FIG. 5 is a perspective drawing of wheel assembly 12 in a deployed condition. Wheel 42 is omitted for clarity. Pivotal axle assembly (41 of FIG. 4) comprises axle 43, guide piston 52, and lock pin 53 housed in cylinder 54. Guide piston 52 slides in cylinder 54. Locking pin 53 is biased to fit in locking aperture 55 of locking drum 57 by spring 56. Lock peg 58 locks drum 57 to leg 49 and 50, but allows pivoting of clevis 59. One end of collapsible strut 44 is attached to clevis 59 and the other or second end of collapsible strut 44 is attached to lower slide 37 (see FIG. 3). Thus, clevis 59 end of collapsible strut 44 is pivotally attached to the pivotal strut (legs 49 and 50) and locking drum 57 is fixed to the bottom end of strut legs 49 and 50. Locking aperture 55 of locking drum 57 is located to position and lock axle 43 in a horizontal position when collapsible or hinged strut 44 is in a fully extended position. The fully extended position positions the wheels further apart than the width of the bag, resulting in added stability of the bag when standing or being transported.

Hinged strut 44 comprises hinge 60 of FIG. 5A which allows the legs of hinged strut 44 to pivot about the hinge. The strut is restrained to a fully extended (straight) position by restrainer 61.

Wheel assembly 12 is deployed by fully extending hinged strut 44 and locking upper slide (36 of FIG. 3) in its lower position by engaging lock 46. The axle 43 of wheel 42 is locked in a horizontal position by lock pin 53 engaging locking drum 57. Wheel assembly 12 is stowed by pulling up on hinge 60 to pivot hinged strut 44. Slide 36 is locked in the up position as shown in FIG. 3 by upper lock 45. Wheel 42 is placed in its stowed (axle 43 horizontal) position as shown in FIG. 3 by pulling wheel 42 outward, disengaging lock pin 53 from lock drum 57. Pocket 14 is then closed to complete stowage and provide a neat, clean appearance.

FIG. 6 shows a side elevation drawing of deployable leg 13. Leg 13 comprises foot 63 at the bottom end of the leg 13. Leg 13 is pivotally attached to the bottom of bag 10 by bracket 64 and leg pivot pin 65. Spring 66 biases leg 13 to its deployed position against stop 68. To stow leg 13, the leg is pivoted as shown in the figure to engage clamp 67. Leg clamp 67 is attached to the bottom of bag 10 by fasteners.

FIG. 7 shows deployable or pivoting handle 16, comprising grip 70, shaft 71. and handle clevis 72. Handle clevis 72 is pivotally attached to handle bracket 73 which is attached to the upper collar of bag 10 in a manner described for longitudinal track 30. Handle bracket 73 comprises two spring biased pins 74 and 75 which engage an aperture 76 in handle clevis 72. The relative locations of the pins 74 and 75 and aperture 76 define the deployed and stowage positions of the handle. Pins 74 and 75 are pressed against the pin spring (not shown) to disengage the handle from the respective position. Handle bracket 73 comprises handle flange 79 and is attached to bag 10 by clamping bag 10 between flange 79 and a backing plate (not shown) with fasteners 77. Closable handle pocket 78 covers the handle when stowed.

Accordingly the reader will see the transportable golf bag provides a golf bag which can be easily moved by the use of enclosed wheel assemblies which are easily and quickly deployed or stowed. The device comprises the following additional advantages:

- no separate frame is required, making the device simple and inexpensive;
- the wheel assemblies are completely covered when in the stowed position, protecting the components from damage and contamination, and improving the appearance of the device;
- the deployable leg allows the bag to stand on its own for the convenience of the user; and
- the handle and leg and be stowed for safe storage, hand carrying, and improved appearance.

Although the description above contains many specifications, these should not be construed as limiting the scope of the invention but as merely providing illustrations of some of the presently preferred embodiments of this invention.

For example the wheel assemblies could be made to deploy by spring action, etc.

Thus the scope of the invention should be determined by the appended claims and their legal equivalents, rather than by the examples given.

I claim:

1. A transportable golf club holder for carrying golf clubs comprising:

a semi-rigid bag having a pair of closable pockets attached to lower ends of the bag on opposed sides thereof; and a pair of retractable wheel assemblies, each wheel assembly being movable between an extended position in which a support wheel is in ground engagement and a stored position in which the wheel assembly is fully received within a respective one of the pair of closable pockets, each wheel assembly including a substantially vertical track secured within a respective pocket, upper and lower slide members movably secured to the track, an upper strut having an upper end pivotally secured to the upper slide member and a lower end pivotally secured to a wheel axle, the support wheel being rotatably mounted on the axle, a collapsible lower strut, the lower strut having outer ends pivotally connected to the lower end of the upper strut and the lower slide member respectively, means for releasably locking the collapsible lower strut in an extended position, and upper and lower locking means for selectively locking the upper slide member to the track at predetermined positions corresponding to the stored and extended positions respectively of the wheel assembly.

2. The holder of claim 1, wherein the substantially vertical track is fixed to the semi-rigid bag so that each wheel assembly is substantially supported by the semi-rigid bag.

3. The holder of claim 1 wherein the collapsible lower strut comprises a pair of strut members pivotally connected at inner ends thereof.

4. A device as in claim 1 further comprising a deployable leg, the leg having a stored position and a deployed position, the deployed position for supporting the golf club holder in an upright position.

5. A device as in claim 1 further comprising a deployable handle, the handle having a stored position and a deployed position, the deployed position for holding and transporting the device.

* * * * *